US009869130B2

(12) United States Patent
Rose et al.

(10) Patent No.: US 9,869,130 B2
(45) Date of Patent: Jan. 16, 2018

(54) ULTRA-HIGH ROP BLADE ENHANCEMENT

(71) Applicant: Varel International Ind., L.P., Carrollton, TX (US)

(72) Inventors: Karl Wayne Rose, Burleson, TX (US); Timothy Anderson, Katy, TX (US); Kevin Wayne Schader, Spring, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 353 days.

(21) Appl. No.: 14/684,018

(22) Filed: Apr. 10, 2015

(65) Prior Publication Data

US 2015/0292269 A1 Oct. 15, 2015

Related U.S. Application Data

(60) Provisional application No. 61/978,098, filed on Apr. 10, 2014.

(51) Int. Cl.
*E21B 10/43* (2006.01)
*E21B 10/46* (2006.01)
(Continued)

(52) U.S. Cl.
CPC ..... *E21B 10/43* (2013.01); *E21B 10/46* (2013.01); *E21B 10/55* (2013.01); *E21B 10/42* (2013.01);
(Continued)

(58) Field of Classification Search
CPC ..... E21B 10/46; E21B 10/43; E21B 10/55; E21B 10/5735; E21B 10/567;
(Continued)

(56) References Cited

U.S. PATENT DOCUMENTS 4,397,361 A 8/1983 Langford, Jr.
4,499,958 A 2/1985 Radtke
(Continued)

OTHER PUBLICATIONS

Young, Lee W., International Search Report and Written Opinion issued in international application No. PCT/US15/25439, dated Jun. 16, 2015, dated Jul. 9, 2015, 8 pages, Alexandria, Virginia.
(Continued)

*Primary Examiner* — George S Gray

(57) ABSTRACT

A drill bit for drilling a hole in an earth formation includes a bit body and a blade extending from the bit body. The blade has a leading section, a top section, and a plurality of transition sections extending between the leading section and the top section. The drill bit further includes a plurality of cutters. Each cutter is positioned in a respective cutter pocket formed in the blade. Each cutter extends beyond the top section of the blade, and each transition section of the blade is between adjacent cutter pockets. The drill bit further includes a plurality of abrasion resistant inserts. Each abrasion resistant insert is positioned in a respective insert pocket formed in the blade. The plurality of abrasion resistant inserts are designed to cut into an earth formation. At least a portion of each abrasion resistant insert is disposed at a respective transition section of the blade.

22 Claims, 9 Drawing Sheets

(51) Int. Cl.
*E21B 10/55* (2006.01)
*E21B 10/42* (2006.01)
*E21B 10/54* (2006.01)

(52) U.S. Cl.
CPC ..... *E21B 10/54* (2013.01); *E21B 2010/425* (2013.01)

(58) Field of Classification Search
CPC .... E21B 10/42; E21B 10/54; E21B 2010/545; E21B 2010/425
USPC ..... 175/57, 379, 431, 430, 426, 428, 432, 175/434
See application file for complete search history.

(56) References Cited

U.S. PATENT DOCUMENTS 4,913,247 A 4/1990 Jones
5,287,937 A 2/1994 Sollami et al.
5,531,281 A 7/1996 Murdock
5,992,549 A 11/1999 Fuller
6,021,858 A * 2/2000 Southland ..... E21B 10/43 175/393
6,290,007 B2 9/2001 Beuershausen et al.
6,408,958 B1 6/2002 Isbell
6,684,967 B2 2/2004 Mensa-Wilmot
7,237,628 B2 7/2007 Desai
7,597,159 B2 10/2009 Overstreet
7,624,825 B2 12/2009 Singh
7,677,333 B2 3/2010 Mensa-Wilmot
8,020,641 B2 9/2011 Welch
2002/0144843 A1* 10/2002 Mensa-Wilmot ... E21B 10/5735 175/331
2007/0205023 A1* 9/2007 Hoffmaster ..... E21B 10/43 175/408
2008/0083568 A1 4/2008 Overstreet
2009/0055135 A1* 2/2009 Tang ..... E21B 10/00 703/1
2010/0133013 A1 6/2010 Hahati et al.
2011/0155472 A1* 6/2011 Lyons ..... E21B 10/55 175/331
2012/0205163 A1 8/2012 Azar
2012/0234610 A1* 9/2012 Azar ..... E21B 10/26 175/431
2013/0206483 A1* 8/2013 Johnson ..... B23P 15/28 175/425
2013/0247475 A1 9/2013 Lind

OTHER PUBLICATIONS

European Search Report; dated Oct. 13, 2017; European Patent Application No. 15776900.1-1609 / 3129577; PCT/US2015025439.

* cited by examiner

ULTRA-HIGH ROP BLADE ENHANCEMENT

CROSS REFERENCE TO RELATED APPLICATIONS

This patent application claims priority under 35 U.S.C. §119 to U.S. Provisional Patent Application No. 61/978,098, entitled "Ultra-High ROP Blade Enhancement" filed on Apr. 10, 2014, the entire content of which is being incorporated by reference herein.

TECHNICAL FIELD

The present invention relates generally to downhole tools used in subterranean drilling, and more particularly, to enhancing cutting efficiency of the blade.

BACKGROUND OF THE INVENTION

Drill bits are commonly used for drilling bore holes or wells in earth formations. One type of drill bit is a fixed cutter drill bit which typically includes a plurality of cutting elements, or cutters, disposed within a respective cutter pocket formed within one or more blades of the drill bit.

FIG. 1A shows a perspective view of a drill bit 100, or fixed cutter drill bit 100, in accordance with the prior art. FIG. 1B shows a profile of the drill bit 100 of FIG. 1 in accordance with the prior art. Referring to FIGS. 1A and 1B, the drill bit 100 includes a bit body 110 that is coupled to a shank 115 and is designed to rotate in a counter-clockwise direction 190. The shank 115 includes a threaded connection 116 at one end 120. The threaded connection 116 couples to a drill string (not shown) or some other equipment that is coupled to the drill string. The threaded connection 116 is shown to be positioned on the exterior surface of the one end 120. This positioning assumes that the drill bit 100 is coupled to a corresponding threaded connection located on the interior surface of a drill string (not shown). However, the threaded connection 116 at the one end 120 is alternatively positioned on the interior surface of the one end 120 if the corresponding threaded connection of the drill string, or other equipment, is positioned on its exterior surface in other exemplary embodiments. A bore (not shown) is formed longitudinally through the shank 115 and extends into the bit body 110 for communicating drilling fluid during drilling operations from within the drill string to a drill bit face 111 via one or more nozzles 114 formed within the bit body 110.

The bit body 110 includes a plurality of gauge sections 150 and a plurality of blades 130 extending from the drill bit face 111 of the bit body 110 towards the threaded connection 116, where each blade 130 extends to and terminates at a respective gauge section 150. The blade 130 and the respective gauge section 150 are formed as a single component, but are formed separately in certain drill bits 100. The drill bit face 111 is positioned at one end of the bit body 110 furthest away from the shank 115. One or more of the plurality of blades 130 are either coupled to the bit body 110 or are integrally formed with the bit body 110. The gauge sections 150 are positioned at an end of the bit body 110 adjacent the shank 115. The gauge section 150 includes one or more gauge cutters (not shown) in certain drill bits 100. The gauge sections 150 typically define and hold the entire hole diameter of the drilled hole. A junk slot 122 is formed, or milled, between each consecutive blade 130, which allows for cuttings and drilling fluid to return to the surface of the wellbore (not shown) once the drilling fluid is discharged from the nozzles 114 during drilling operations.

A plurality of cutters 140 are coupled to each of the blades 130 within a respective cutter pocket 160 formed in the blade. The cutters 140 may be formed in an elongated cylindrical shape or other shapes. Each cutter 140 typically includes a cutting surface 144, and a portion of the cutter 140 including the cutting surface 144 extends outwardly from the blade 130 from within the respective cutter pocket 160. The cutter 140 is positioned within the pocket 160 such that the cutting surface 144 extends outwardly from the top section 154 of the blade 130. The cutting surface 144 can be formed from a hard material, such as bound particles of polycrystalline diamond forming a diamond table. In some embodiments, a line 180 (shown FIG. 1B) connecting the outer most tip of each cutter 140 of the drill bit 100 represents the profile of the drill bit 100.

Each blade 130 includes a leading section 152, a top section 154, and a trailing section 156. The top surface 154 extends from one end of the trailing section 156 to an end of the leading section 152. The leading section 152 faces in the direction of rotation 190. Each blade 130 also includes transition sections 158. Transition sections 158 extend between the top section 154 and the leading section 152. Each individual transition section 158 is between two adjacent cutter pockets 160. Each transition section 158 has a curvature that generally has a radius of larger than 5 millimeters.

During some drilling operations (e.g., drilling operations that involve relatively high instantaneous rate of penetration (ROP)), the depth of cut (DOC) resulting from the drilling by the drill bit may be significantly greater than the exposure of the cutters of the drill bit. A DOC that is greater than the exposure of the cutters may indicate that the blade of the drill bit may also be cutting and/or pushing earth formation as the drill bit rotates. Thus, it may be desirable to improve the cutting efficiency of the blade.

SUMMARY

In an exemplary embodiment, a drill bit for drilling a hole in an earth formation includes a bit body and a blade extending from the bit body. The blade has a leading section, a top section, and a plurality of transition sections extending between the leading section and the top section. The leading section faces a direction of rotation of the drill bit. The drill bit further includes a plurality of cutters. Each cutter is positioned in a respective cutter pocket formed in the blade. Each cutter extends beyond the top section of the blade, and each transition section of the blade is between adjacent cutter pockets. The drill bit further includes a plurality of abrasion resistant inserts. Each abrasion resistant insert is positioned in a respective insert pocket formed in the blade. The plurality of abrasion resistant inserts are designed to cut into an earth formation. At least a portion of each abrasion resistant insert is disposed at a respective transition section of the blade.

In another exemplary embodiment, a drill bit for drilling a hole in an earth formation includes a bit body and a blade extending from the bit body. The blade has a leading section, a top section, and a plurality of transition sections extending between the leading section and the top section. The leading section faces a direction of rotation of the drill bit. The drill bit further includes a plurality of cutters. Each cutter is positioned in a respective cutter pocket formed in the blade. Each cutter extends beyond the top section of the blade, and each transition section of the blade is between adjacent cutter pockets. Each transition section of the blade has a curvature having a radius that ranges between approximately 1 millimeter and 5 millimeters In another exemplary embodiment, a drill bit for drilling a hole in an earth formation includes a bit body and a blade extending from the bit body. The blade has a leading section, a top section, and a plurality of transition sections extending between the leading section and the top section. The leading section faces a direction of rotation of the drill bit. The drill bit further includes a plurality of cutters. Each cutter is positioned in a respective cutter pocket formed in the blade. Each cutter extends beyond the top section of the blade, and each transition section of the blade is between adjacent cutter pockets. At least one transition section of the blade has a sharp edge at an intersection of the leading section of the blade and the top section of the blade.

In another exemplary embodiment, a drill bit for drilling a hole in an earth formation includes a bit body and a blade extending from the bit body. The blade has a leading section, a top section, and a plurality of transition sections extending between the leading section and the top section. The leading section faces a direction of rotation of the drill bit. The drill bit further includes a plurality of cutters. Each cutter is positioned in a respective cutter pocket formed in the blade. Each cutter extends beyond the top section of the blade, and each transition section of the blade is between adjacent cutter pockets. At least one transition section of the blade forms a chamfered edge with the leading section of the blade and the top section of the blade.

These and other aspects, objects, features, and embodiments will be apparent from the following description and the claims.

BRIEF DESCRIPTION OF THE DRAWINGS

The foregoing and other features and aspects of the invention may be best understood with reference to the following description of certain exemplary embodiments, when read in conjunction with the accompanying drawings, wherein.

Figure 1A:
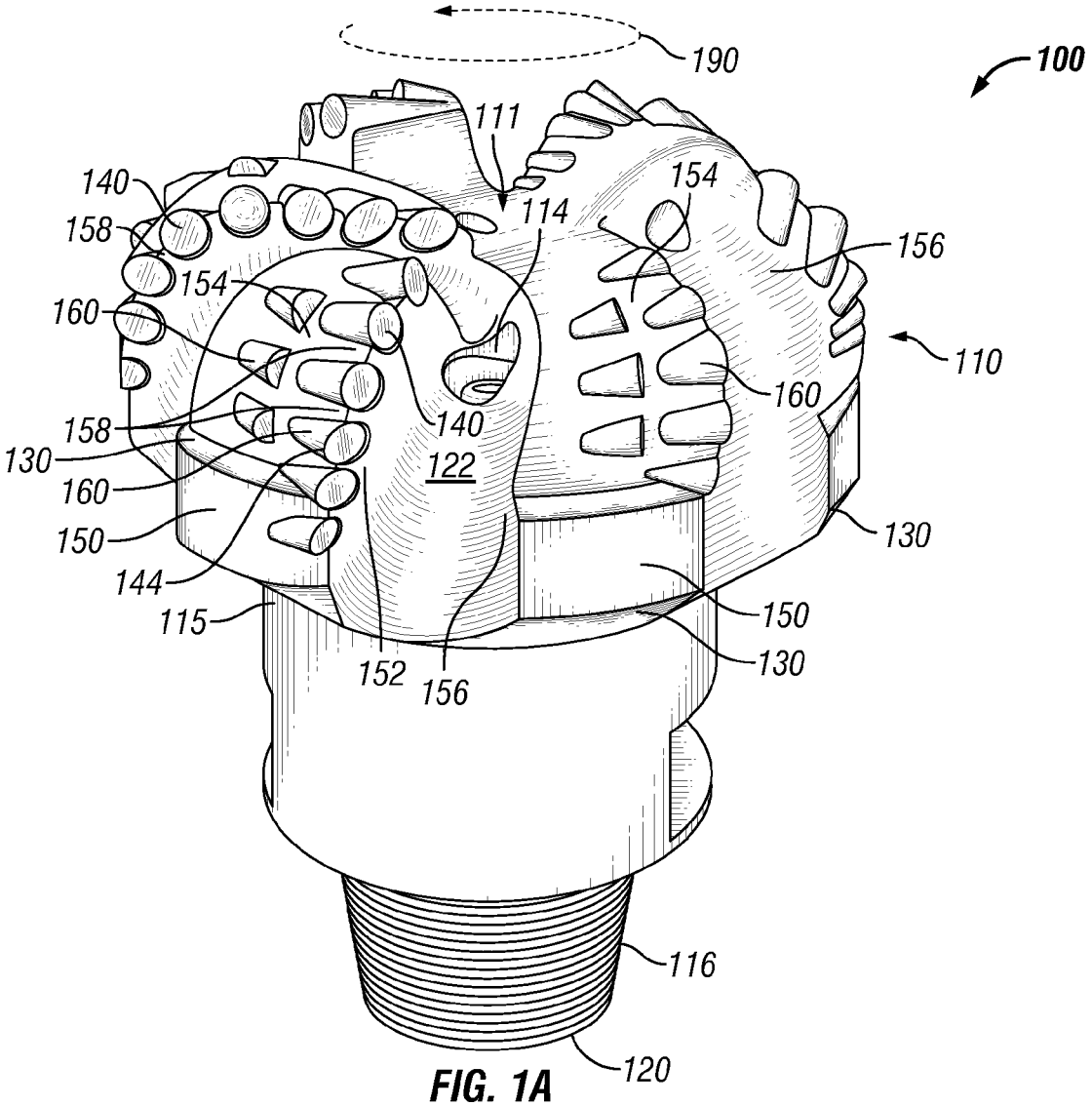
FIG. 1A (Prior Art)
FIG. 1A shows a perspective view of a drill bit in accordance with the prior art.
Figure 1B:
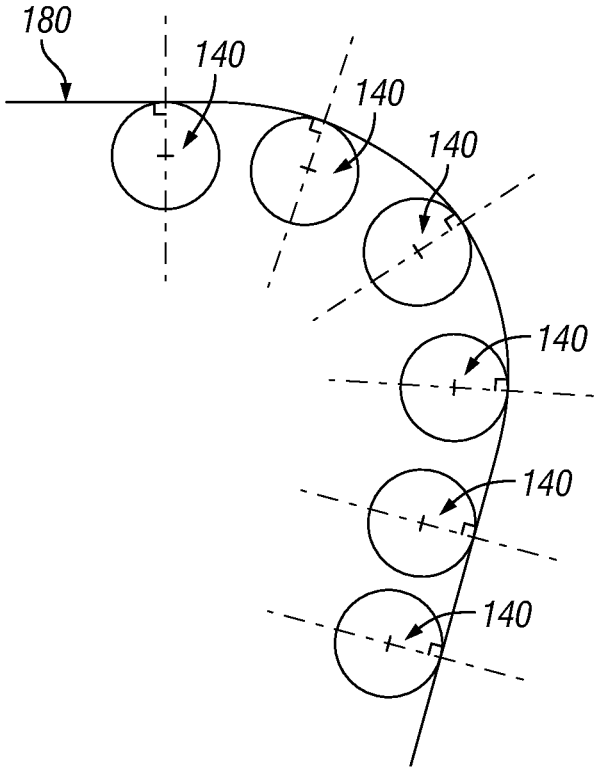
FIG. 1B (Prior Art)
FIG. 1B shows a profile of the drill bit of FIG. 1A in accordance with the prior art.

The drawings illustrate only exemplary embodiments of the invention and are therefore not to be considered limiting of its scope, as the invention may admit to other equally effective embodiments.

DETAILED DESCRIPTION OF INVENTION

The present invention is directed to downhole tools used in subterranean drilling. In particular, the application is directed to enhancing the cutting efficiency of the blade by reducing a radius of a transition region of the blade, changing the rake angle of the blade, and/or by coupling abrasion resistant inserts to the blade between the cutter pockets of the blade. Although some of the drawings illustrate exemplary embodiments of a fixed cutter drill bit, the description with respect to the exemplary embodiments of the invention may be applicable to other types of downhole drill bits.

The present invention may be better understood by reading the following description of non-limiting, exemplary embodiments with reference to the attached drawings, wherein like parts of each of the figures are identified by like reference characters, and which are briefly described as follows.

Figure 2A:
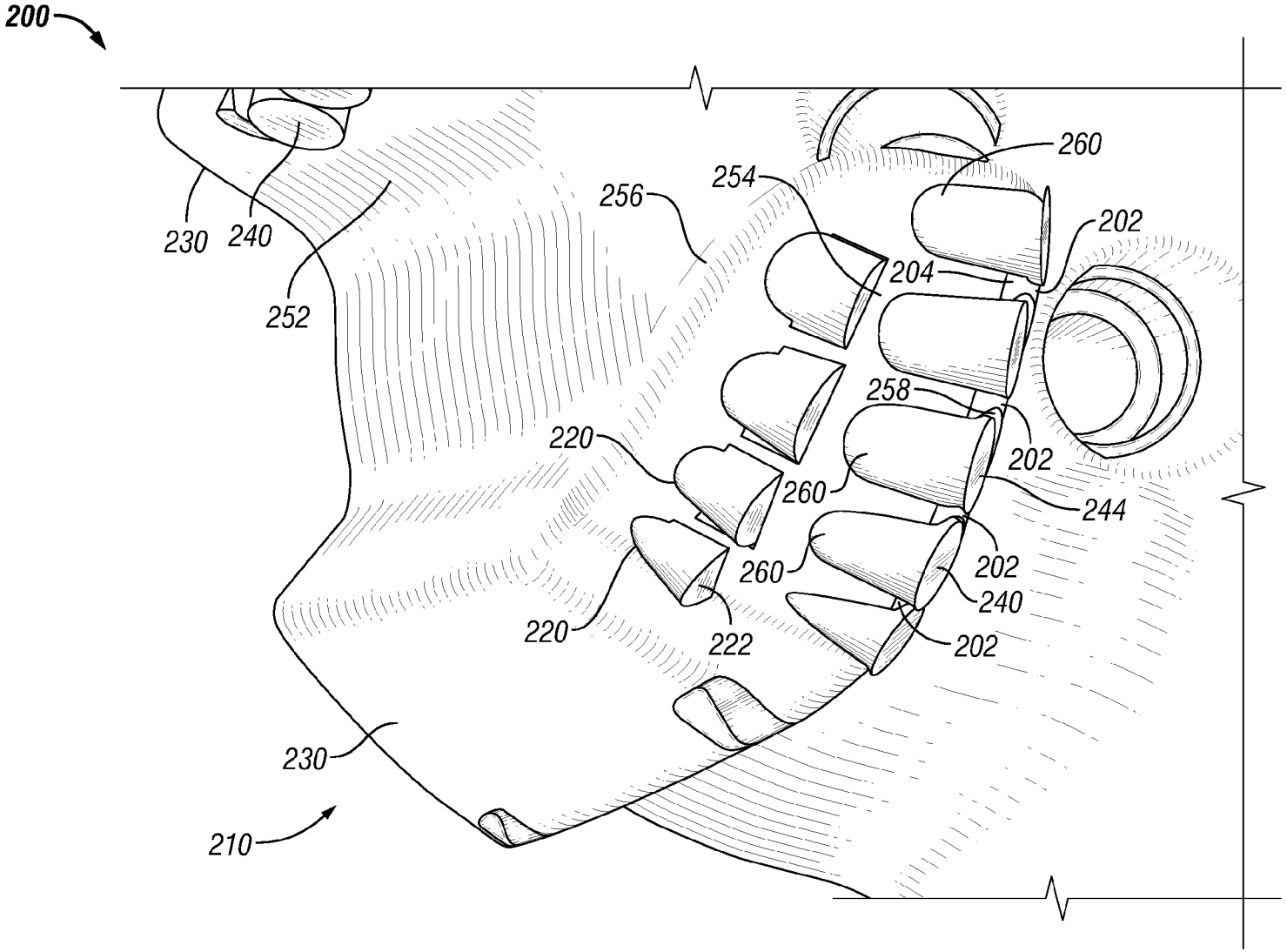
FIGS. 2A-2C illustrate abrasion resistant inserts attached to a blade of a drill bit in accordance with an exemplary embodiment of the present invention.
Figure 2B:
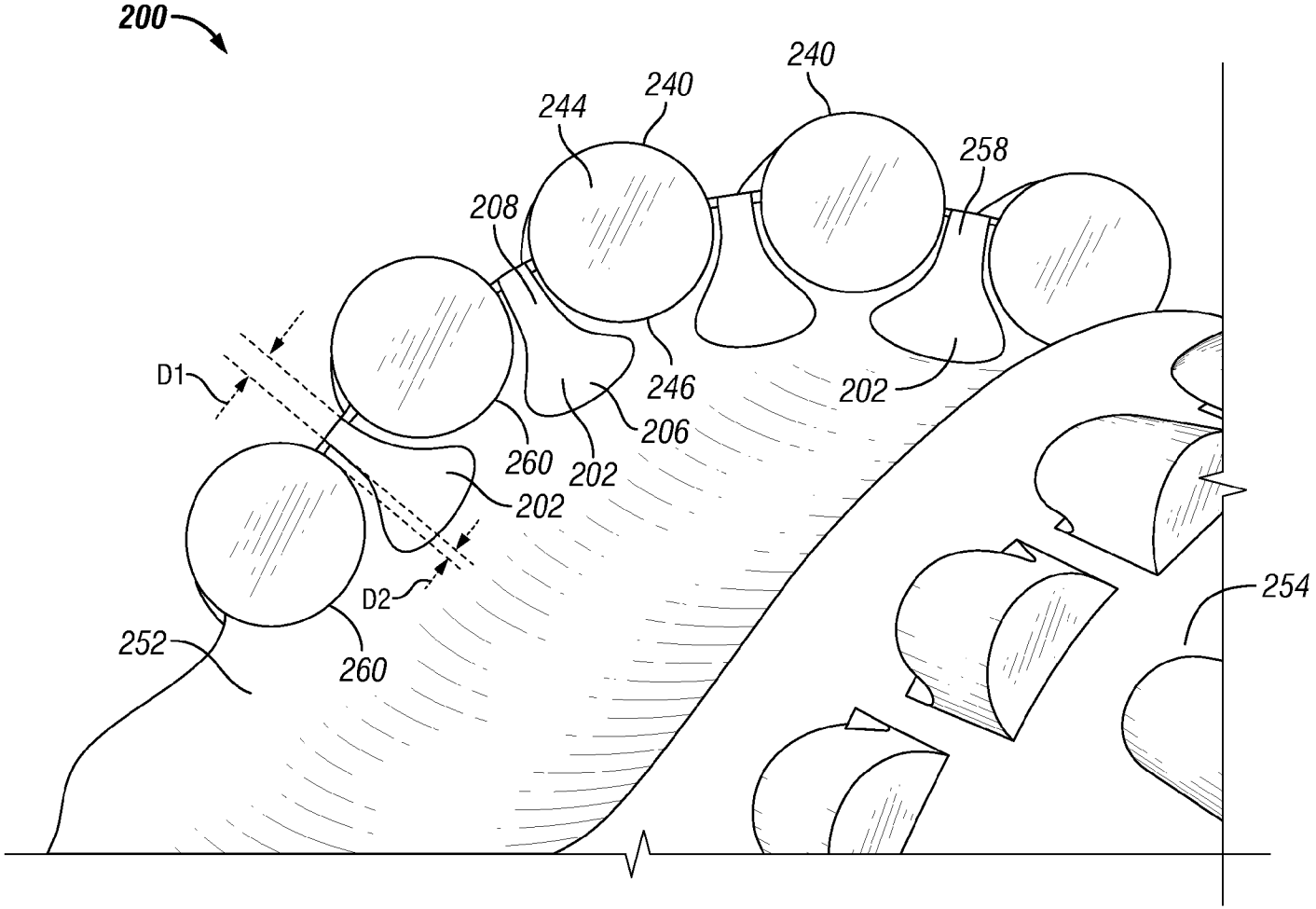
Figure 2C:
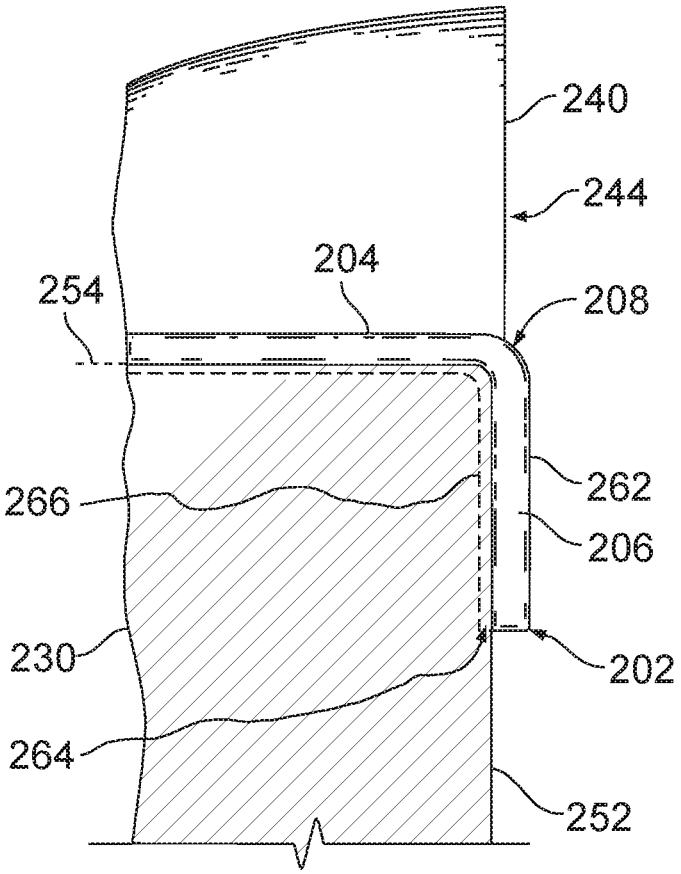

FIGS. 2A-2C illustrate abrasion resistant inserts 202 attached to a blade of a drill bit 200 in accordance with an exemplary embodiment of the present invention. Referring to FIGS. 2A and 2B, the drill bit 200 includes a bit 210. In some example embodiments, the drill bit 200 has the same or substantially the same profile as the drill bit 100 of FIG. 1A. The drill bit 200 also includes blades 230 extending out from the bit body. Each blade 230 has a leading section 252, a top section 254, and a plurality of transition sections 258 extending between the leading section 252 and the top section 254. Similar to the leading section 152 of FIG. 1A, the leading section 252 faces a direction of rotation of the drill bit 200. The drill bit 200 further includes a plurality of cutters 240. Each cutter 240 is positioned in a respective cutter pocket 260 formed in each blade 230. Each transition section 258 of the blade 230 is between adjacent cutter pockets 260. Each cutter 240 protrudes/extends beyond the top section 254 of the blade 230 such that at least a portion of each cutter 240 is above the surface of the top section 254. In some exemplary embodiments, at least a portion of each cutter 240 also extends beyond the leading section 252 of the blade 230.

In some exemplary embodiments, the cutters 240 may have an elongated cylindrical shape. Each cutter 240 typically includes a cutting surface 244, and a portion of each cutter 240 including at least a portion of the cutting surface 244 extends outwardly from the blade 130 from within the respective cutter pocket 260. The cutting surface 144 is generally formed from a hard material, such as bound particles of polycrystalline diamond forming a diamond table.

In some exemplary embodiments, each blade 230 may include secondary cutter pockets 220 that have respective secondary cutters 222 positioned therein. In alternative embodiments of the drill bit 200, the secondary cutter pockets 220 and the secondary cutters 222 may be omitted from the drill bit 200.

Referring to FIGS. 2A-2C, in some exemplary embodiments, the drill bit 200 further includes abrasion resistant inserts 202. Each abrasion resistant insert 202 may be positioned in a respective insert pocket 264 formed in the blade 230. The abrasion resistant inserts 202 are designed to cut into an earth formation during a drilling operation. The abrasion resistant inserts 202 can reduce wear of the blade 230 and maintain effectiveness of the blade 230 for cutting into formation than a blade without the abrasion resistant inserts 202. The abrasion resistant inserts 202 may define the exposure of the drill bit 200.

In some exemplary embodiments, each abrasion resistant insert 202 includes a transition portion 208 that is between a leading portion 206 and a top portion 204 of the abrasion resistant insert 202. The transition portion 208 of each abrasion resistant insert 202 is disposed at a respective transition section 258 of each blade 230.

In some exemplary embodiments, at least a portion of some or all abrasion resistant inserts 202 protrudes/extends out beyond the blade 230. For example, each abrasion resistant insert 202 may extend beyond the top section 254. Similarly, some or all abrasion resistant inserts 202 may extend beyond a respective transition section 258 and beyond the leading section 252 of the blade 230. In some exemplary embodiments, each abrasion resistant insert 202 may protrude/extend out beyond the top section 254 a distance of up to approximately 6 millimeters (mm). Similarly, each abrasion resistant insert 202 may protrude/extend out beyond the respective transition section 258 and beyond the leading section 252 of the blade 230 a distance of up to approximately 6 mm. In some exemplary embodiments, a portion of each abrasion resistant insert 202 may be flush with a surface of the blade 230 while another portion of each abrasion resistant insert 202 extends beyond the surface of the blade 230. Alternatively or in addition, a portion of each abrasion resistant insert 202 may be below the surface of the blade 230 such that a portion of a surface 262 of the abrasion resistant insert 202 is below a surface of the blade section 252.

The leading portion 206 of each abrasion resistant insert 202 is disposed at the leading section 252 of the blade 230. Similarly, the top portion 204 of each abrasion resistant insert 202 is disposed at the top section 254 of the blade 230. The leading portion 206 of each abrasion resistant insert 202 may protrude/extend out beyond the leading section 252 of the blade 230. Similarly, the top portion 204 of each abrasion resistant insert 202 may protrude/extend out beyond the top section 254 of the blade 230. In some exemplary embodiments, the transition portion 208 of each abrasion resistant insert 202 may also protrude/extend out beyond the transition section 258 of the blade 230.

In some exemplary embodiments, each cutter 240 extends from the top section 254 of the blade 230 farther than the abrasion resistant inserts 202 extend from the top section 254. In some example embodiments, a spacing D2 (shown in FIG. 2B) between each cutter pocket 260 and an adjacent abrasion resistant insert 202 may be up to approximately 2 mm. For example, the spacing D2 may be approximately 0.5 mm. Alternatively, the spacing D2 between some cutter pockets 260 and a respective adjacent abrasion resistant insert 202 is larger than 2 mm while the spacing D2 is smaller than 2 mm with respect to other cutter pockets 260 and respective adjacent abrasion resistant inserts 202. In some exemplary embodiments, the spacing D2 between the cutter pocket 260 and the adjacent abrasion resistant insert 202 may be smaller than the spacing between the cutter pocket 260 and the adjacent insert pocket 264 (shown in FIG. 2C) in which the adjacent abrasion resistant insert 202 is positioned. In some exemplary embodiments, the blade 230 may not include the abrasion resistant insert 202 between some adjacent cutters 240. The spacing D1 between two adjacent cutters 240 may be, for example, larger than approximately 2 mm. In some alternative embodiments, the spacing D1 between two adjacent cutters 240 may be approximately 2 mm or smaller than 2 mm.

The leading portion 206 of some or all abrasion resistant inserts 202 may extend along the leading section 252 of the blade 230 for a distance of up to approximately 22 mm. Similarly, the top portion 204 of some or all abrasion resistant inserts 202 may extend along the top section 254 of the blade 230 for a distance of up to approximately 25 mm.

In some exemplary embodiments, the leading portion 206 of some or all abrasion resistant inserts 202 may have a rake angle ranging from approximately −15 degrees to approximately 35 degrees. The rake angle of the leading portion 206 of each abrasion resistant insert 202 is the angle between a plane that includes the surface of the leading portion 206 of the particular abrasion resistant insert 202 and a vertical axis extending through the particular abrasion resistant insert 202. The vertical axis is perpendicular to the profile of the drill bit 200. In some exemplary embodiments, the top portion 204 of some or all abrasion resistant inserts 202 has a relief angle ranging from approximately −15 degrees to approximately 35 degrees. The relief angle of the top portion 204 each abrasion resistant insert 202 is the angle between a plane that includes the surface of the top portion 204, and a horizontal axis that is perpendicular to the vertical axis. The rake and relief angles of the abrasion resistant inserts 202 are described in more detail with respect to FIGS. 5A and 5B.

In some exemplary embodiments, the insert pocket 264 (shown in FIG. 2C) may be approximately 1 mm deep into the blade 230 relative to the respective surfaces of the leading section 252, the top section 254, and the transition section 256. Thus, each abrasion resistant insert 202 may be inserted into a respective insert pocket 264 approximately 1 mm such that a back surface 266 of the abrasion resistant insert 202 is approximately 1 mm into the blade 230 from the surface of the blade 230. However, in some alternative embodiments, the insert pocket 264, formed in the blade 230, may be deeper or shallower than 1 mm. Thus, each abrasion resistant insert 202 may be inserted into a respective insert pocket 264 more or less than 1 mm.

In some exemplary embodiments, each abrasion resistant insert 202 is a thermally stabilized polycrystalline (TSP) diamond compact or another type of polycrystalline diamond compact (PDC). In general, each abrasion resistant insert 202 may be made of tungsten carbide, diamond, impregnated material, or any other abrasion resistant material know to those of ordinary skill in the art having the benefit of the present disclosure. The abrasion resistant inserts 202 may be formed in the bit body 210 during the process of forming the bit body using methods such as molding. The abrasion resistant inserts 202 may also be attached to the blades 230 using a brazing process known to those of ordinary skill in the art. The insert pockets 264 may be formed during or after the formation of the bit body using methods known to those of ordinary skill in the art. For example, the insert pockets 264 may be formed by machining or milling into the blade 230.

In some exemplary embodiments, the abrasion resistant insert 202 may have a disc shape, a brick shape, cube shape, an hourglass shape, or an elliptical shape. In general, the abrasion resistant insert 202 may have a symmetrical or non-symmetrical shape. The abrasion resistant insert 202 may have a surface 262 (shown in FIG. 2C) that is flat. Alternatively, the surface 262 may be a concave/scoop surface (curving toward the insert pocket 264) or another suitable surface for cutting and/or removing earth formation. In general, the abrasion resistant inserts 202 may be sized and shaped to provide optimum cutting action by the blade 230. For example, the sizes and shapes of the abrasion resistant inserts 202 may be designed for different types of earth formation.

In some exemplary embodiments, some or all transition sections 258 may have a respective curvature having a radius of approximately 5 mm or larger. In some alternative exemplary embodiments, some or all transition sections 258 may have a respective curvature with a radius ranging from approximately 1 mm to approximately 3.5 mm. Alternatively, the radius of the curvature may range from approximately 1 mm to approximately 3 mm, from approximately 1 mm to approximately 2.5 mm, or from approximately 1 mm to approximately 2 mm for some or all transition sections 258. For example, the transition sections 258 with a particular radius may be desired in some application while the transition sections 258 with a different radius may be preferred in a different application, for example, based on a rock formation of a well. In some alternative exemplary embodiments, one or more of the transition sections 258 of the blade 230 may have a sharp edge at the intersection of the leading section 252 of the blade 230 and the top section 254 of the blade 230. Alternatively, one or more of the transition sections 258 of the blade 230 may be a chamfered edge.

Figure 4A:
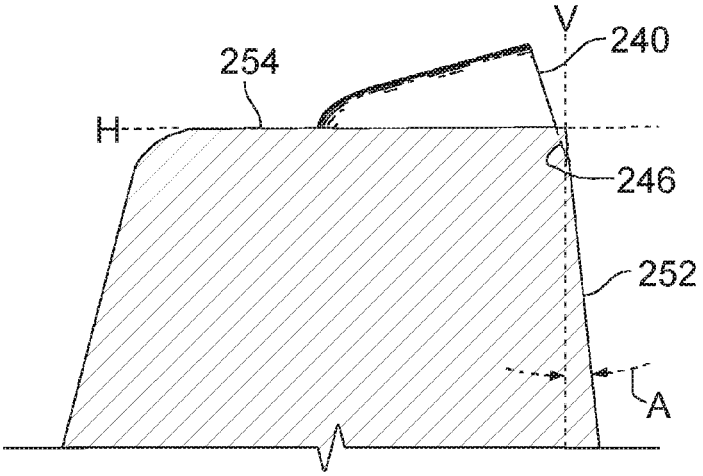
FIGS. 4A-4C show sectional views of a blade illustrating rake angle and relief angle of a blade of the drill bit of FIG. 2A in accordance with an exemplary embodiment of the present invention.
Figure 4B:
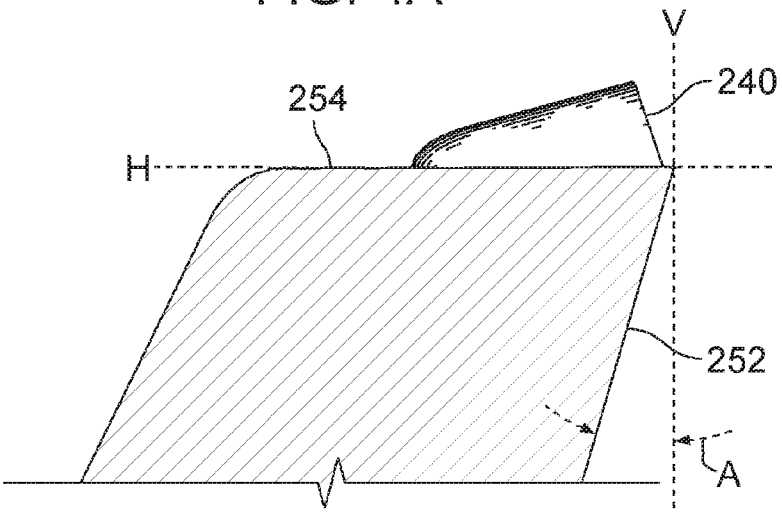
Figure 4C:
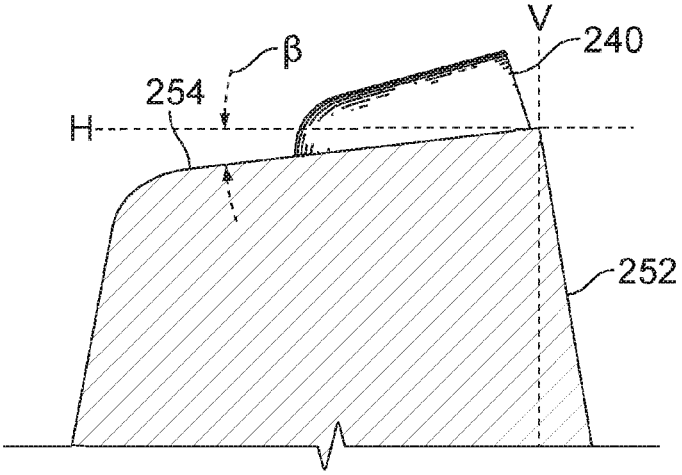

In some exemplary embodiments, the leading section 252 of the blade 230 has a rake angle within the ranges described with respect to FIGS. 4A-4C. Similarly, in some exemplary embodiments, the top section 254 of the blade 230 may have a relief angle within the ranges described with respect to FIGS. 4A-4C.

The abrasion resistant inserts 202 may improve the cutting efficiency of the blade 230 when the blade 230 engages rocks during drilling operations. For example, the abrasion resistant inserts 202 may result in reduction in damage to areas of the blade 230 including the leading section 252, the top section 254, and the transition sections 258 by providing a more effective way to shear rocks. The blade 230 with the abrasion resistant inserts 202 may have improved sharpness and abrasion resistance as compared to a blade without the abrasion resistant inserts 202.

Figure 3A:
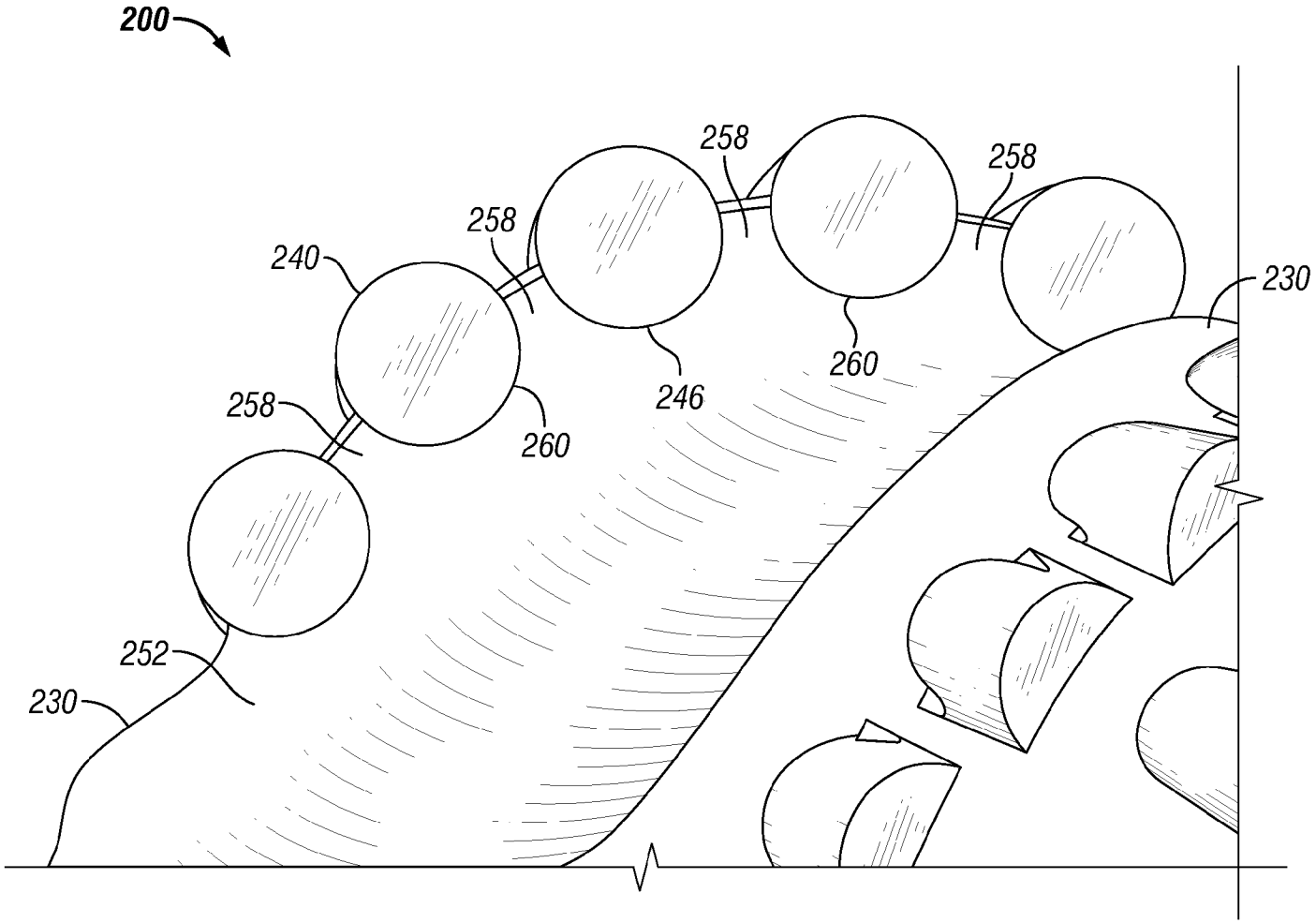
FIG. 3A illustrates transition sections of a blade of the drill bit of FIG. 2A in accordance with an exemplary embodiment of the present invention.
Figure 3B:
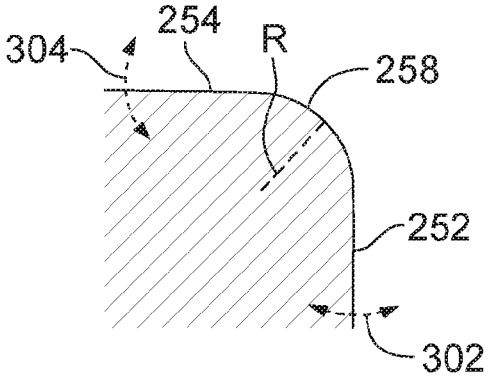
FIG. 3B illustrates a sectional view of a transition section of the blade of the drill bit of FIG. 2A as a curved edge in accordance with an exemplary embodiment of the present invention.
Figure 3C:
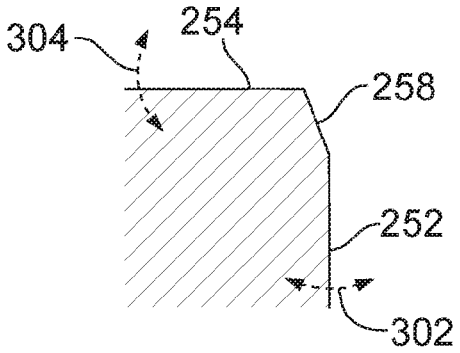
FIG. 3C illustrates a sectional view of a transition section of a blade of the drill bit of FIG. 2A as a chamfered edge in accordance with another exemplary embodiment of the present invention.
Figure 3D:
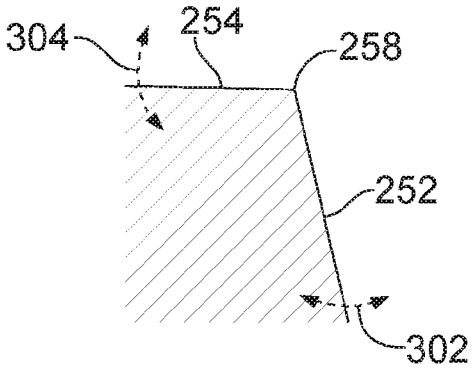
FIG. 3D illustrates a sectional view of a transition section of a blade of the drill bit of FIG. 2A that has a sharp edge in accordance with another exemplary embodiment of the present invention.

FIG. 3A illustrates transition sections 258 of the blade 230 in accordance with an exemplary embodiment of the present invention. FIG. 3B illustrates a sectional view of the transition section 258 of the blade 230 as a curved edge in accordance with an exemplary embodiment of the present invention. FIG. 3C illustrates a sectional view of the transition section 258 of the blade 230 as a chamfered edge in accordance with an exemplary embodiment of the present invention. FIG. 3D illustrates a sectional view of the transition section 258 of the blade 230 that has a sharp edge in accordance with an exemplary embodiment of the present invention. Only the leading section 252, the top section 254, and the transition section 258 of the blade 230 are shown in FIG. 3B-3D for clarity of illustration.

Referring to FIG. 3A, the drill bit 200 includes the cutters 240 that are each positioned in respective cutter pockets 260. Each transition section 258 of the blade 230 is between adjacent cutter pockets 260, and thus between adjacent cutters 240. Each cutter 240 protrudes/extends beyond the transition sections 258 of the blade 230. In some exemplary embodiments, a portion of each cutter 240 also extends beyond the leading section 252 of the blade 230.

Referring to FIGS. 3A and 3B, in some exemplary embodiments, each transition section 258 of the blade 230 may have a respective curvature. In some exemplary embodiments, the radius R of the curvature of each transition section 258 may range from approximately 1 mm to approximately 3.5 mm. In some alternative exemplary embodiments, the radius R of the curvature of each transition section 258 may range from approximately 1 mm to approximately 3 mm. In yet other alternative exemplary embodiments, the radius R of the curvature of each transition section 258 may range from approximately 1 mm to approximately 2.5 mm or from approximately 1 mm to approximately 2 mm. In some exemplary embodiments, some of the transition sections 258 of the blade 230 may have the radius R within one of the above ranges while another one or more of the transition sections 258 of the blade 230 have the radius R within a different one of the above ranges or outside of the above ranges.

The radius R of the curvature of the transition sections 258 in the above ranges may increase the sharpness of the transition sections 258, which in turn may increase the cutting efficiency of the blade 230 when the transition sections 258 engage a rock during drilling operations. The increased cutting efficiency of the blade 230 may result in ROP increase.

In some exemplary embodiments, as illustrated by the dotted double-arrow 302, the leading section 252 may be angled to the right or to the left of the position of the leading section 252 shown in FIG. 3B. For example, the leading section 252 may have a rake angle within the ranges described with respect to FIGS. 4A and 4B. Similarly, as illustrated by the dotted double-arrow 304, the top section 254 may be angled above or below the position of the top section 254 shown in FIG. 3B. For example, the top section 254 may have a relief angle within the ranges described with respect to FIG. 4C.

Referring to FIGS. 3A and 3C, in some exemplary embodiments, some or all of the transition sections 258 of the blade 230 may be a chamfered edge. For example, each transition section 258 may be slanted forty five degrees with respect to plane that includes the leading section 252 of the blade. The transition sections 258 may be slanted in a range that includes a forty five degrees slant. In some exemplary embodiments, as illustrated by the dotted double-arrow 302, the leading section 252 may be angled to the right or to the left of the position of the leading section 252 shown in FIG. 3C. For example, the leading section 252 may have a rake angle within the ranges described with respect to FIGS. 4A-4C. Similarly, as illustrated by the dotted double-arrow 304, the top section 254 may be angled above or below the position of the top section 254 shown in FIG. 3C. For example, the top section 254 may have a relief angle within the ranges described with respect to FIGS. 4A-4C.

Referring to FIGS. 3A and 3D, in some exemplary embodiments, some or all of the transition sections 258 of the blade 230 may have a sharp edge at the intersection of the leading section 252 of the blade 230 and the top section 254 of the blade 230. In some exemplary embodiments, the leading section 252 may have a rake angle within the ranges described with respect to FIGS. 4A-4C. Similarly, the top section 254 may have a relief angle within the ranges described with respect to FIGS. 4A-4C.

Referring to FIGS. 3A-3D, the radius R of the curvature of the transition sections 258 (more clearly shown in FIG. 3B) in the above provided ranges may increase the sharpness of the transition sections 258. Similarly, the transition sections 258 that are chamfered edge (more clearly shown in FIG. 3C) and sharp edge (more clearly shown in FIG. 3D) may also increase the sharpness of the transition sections 258, which may increase the cutting efficiency of the blade 230 when the transition sections 258 engage a rock during drilling operations. The increased cutting efficiency of the blade 230 may result in ROP increase.

FIGS. 4A-4C show sectional views of the blade 230 illustrating the rake angle and the relief angle of the blade 230 of the drill bit 200 of FIG. 2A in accordance with an exemplary embodiment of the present invention. Referring to FIGS. 4A-4C, the rake angle of the leading section 252 of the blade 230 generally refers to the rake angle of the blade 230. Similarly, the relief angle of the top section 254 of the blade 230 generally refers to the relief angle of the blade 230. In some exemplary embodiments, the rake angle of the leading section 252 is the angle between a plane that includes the leading section 252 of the blade 230 and a vertical axis (V) that is perpendicular to the profile of the drill bit 200. For example, in the embodiments illustrated in FIG. 4A-4C, the vertical axis (V) is shown extending through the tip 246 of the cutter 240. In some exemplary embodiments, the relief angle of the top section 254 is the angle between a plane that includes the surface of the top section 254 of the blade 230 and a horizontal axis (H) that is perpendicular to the vertical axis (V).

Referring to FIG. 4A, in some exemplary embodiments, the leading section 252 of the blade 230 may have a rake angle (A) ranging from approximately 6 degrees to approximately 12 degrees to the right of the vertical axis (V). As illustrated in FIG. 4B, in some exemplary embodiments, the leading section 252 of the blade 230 may have the rake angle (A) ranging from approximately 4 degrees to approximately 12 degrees to the left of the vertical axis (V), which is considered as a range of approximately −4 degrees to approximately −12 degrees. In some exemplary embodiments, adjusting the rake angle of the leading section 252 within the range of approximately 4 degrees to approximately 12 on the left side of the vertical axis (V) and within the range of approximately 6 degrees to approximately 12 on the right side of the vertical axis (V) may improve the aggressiveness of the blade 230 in cutting rocks, which in turn may result in increased ROP. In some exemplary embodiments, the rake angle (A) of the leading section 252 of the blade 230 may be outside of the above ranges or may be within a larger range that includes one or both of the above ranges.

Referring to FIG. 4C, in some exemplary embodiments, the top section 254 of the blade 230 has a relief angle (B) ranging from approximately 0 degrees to approximately 10 degrees below the horizontal axis (H). In some exemplary embodiments, the relief angle (B) of the top section 253 of the blade 230 may be outside of the above range or may be within a larger range that includes the above range. In some exemplary embodiments, the top section 254 of the blade 230 may be angled above the horizontal axis (H).

Although the rake angle (A) and the relief angle (B) are described above with respect to the transition section 258 that is a sharp edge (for example, shown in FIG. 3D), the above descriptions of the rake and relief angles are applicable to other shapes of the transition sections 258.

Figure 5A:
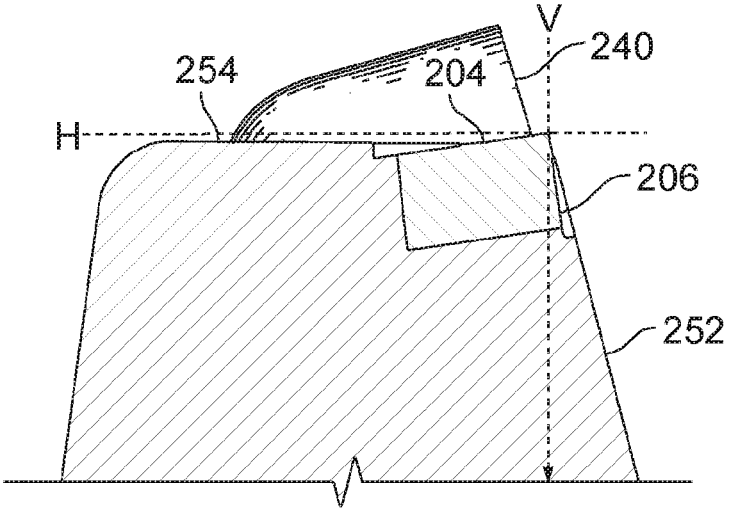
FIGS. 5A and 5B show sectional views of a blade illustrating rake angle and relief angle of an abrasion resistant insert of the drill bit of FIG. 2A in accordance with an exemplary embodiment of the present invention.
Figure 5B:
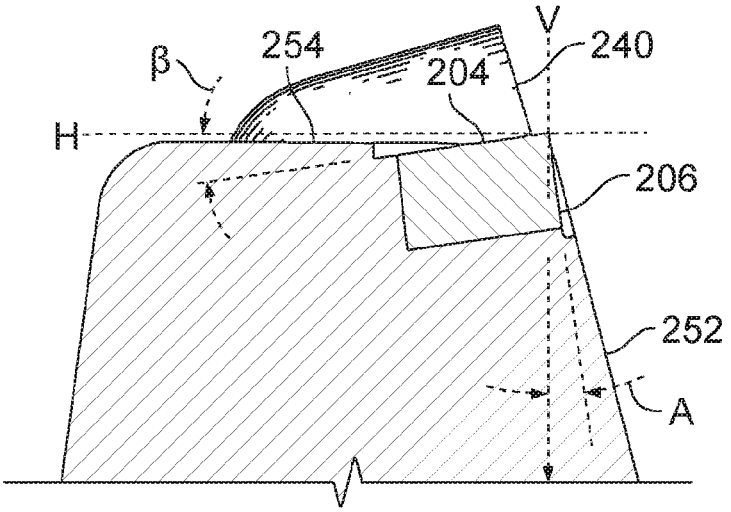

FIGS. 5A and 5B show sectional views of the blade 230 illustrating rake angle and the relief angle of the abrasion resistant insert 202 of the drill bit 200 of FIG. 2A in accordance with an exemplary embodiment of the present invention. Referring to FIGS. 4A-4C, the rake angle of the leading portion 206 of the abrasion resistant insert 202 as used herein generally refers to the rake angle of the abrasion resistant insert 202. Similarly, the relief angle of the top portion 204 of the abrasion resistant insert 202 as used herein generally refers to the relief angle of the abrasion resistant insert 202. In some exemplary embodiments, the leading portion 206 of some or all of the abrasion resistant inserts 202 may have a rake angle (A) ranging from approximately −15 degrees to approximately 35 degrees. The rake angle (A) of the leading portion 206 of each abrasion resistant insert 202 is the angle between a plane that includes the surface of the leading portion 206 of the particular abrasion resistant insert 202 and a vertical axis (V) extending through the particular abrasion resistant insert 202. The vertical axis (V) is perpendicular to the profile of the drill bit 200. Values of the rake angle (A) to the left of the vertical axis (V) are considered as negative angle values, and values of the rake angle (A) to the right of the vertical axis (V) are considered as positive angle values.

In some exemplary embodiments, the top portion 204 of some or all of the abrasion resistant inserts 202 may have a relief angle (B) ranging from approximately −15 degrees to approximately 35 degrees. The relief angle (B) of the top portion 204 is the angle between a plane that includes the surface of the top portion 204, and a horizontal axis (H) that is perpendicular to the vertical axis (V). Values of the relief angle (B) below the horizontal axis (H) are considered as negative angle values, and values of the relief angle (B) above the horizontal axis (H) are considered as positive angle values.

Although each exemplary embodiment has been described in detailed, it is to be construed that any features and modifications that is applicable to one embodiment is also applicable to the other embodiments.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

We claim:

1. A drill bit for drilling a hole in an earth formation, the drill bit comprising:

a bit body;

a blade extending from the bit body, the blade having a leading section, a top section, and a plurality of transition sections extending between the leading section and the top section, wherein the leading section faces a direction of rotation of the drill bit;

a plurality of cutters, each cutter positioned in a respective cutter pocket formed in the blade, wherein each cutter extends beyond the top section of the blade, wherein each transition section of the blade is between adjacent cutter pockets; and an abrasion resistant insert positioned in an insert pocket formed in the blade and designed to cut into an earth formation, wherein a top portion of the abrasion resistant insert is disposed at the top section of the blade and extends from one of the transition sections of the blade, wherein the top portion of the abrasion resistant insert is flush or sub-flush with the top section of the blade.

2. The drill bit of claim 1, wherein, with respect to the top section of the blade, an adjacent cutter extends farther than the abrasion resistant insert.

3. The drill bit of claim 1, wherein a transition portion of the abrasion resistant insert is disposed at the one transition section of the blade.

4. The drill bit of claim 3, wherein a leading portion of the abrasion resistant insert is disposed at the leading section of the blade.

5. The drill bit of claim 4, wherein the leading portion of the abrasion resistant insert extends out beyond the leading section of the blade.

6. The drill bit of claim 4, wherein the leading portion of the abrasion resistant insert extends beyond the leading section of the blade by a distance of less than approximately 4 millimeters.

7. The drill bit of claim 4, wherein the leading portion of the abrasion resistant insert extends along the leading section for a distance of up to approximately 22 millimeters.

8. The drill bit of claim 4, wherein the top portion of the abrasion resistant insert extends along the top section of the blade for a distance of up to approximately 25 millimeters.

9. The drill bit of claim 4, wherein the leading portion of the abrasion resistant insert has a rake angle ranging from approximately −15 degrees to approximately 35 degrees.

10. The drill bit of claim 1, wherein the top portion of the abrasion resistant insert is flush with the top section of the blade.

11. The drill bit of claim 1, wherein a spacing between a cutter pocket and the adjacent abrasion resistant insert is approximately 0.5 millimeter.

12. The drill bit of claim 1, wherein the abrasion resistant insert is a thermally stabilized polycrystalline (TSP) diamond element.

13. The drill bit of claim 1, wherein the abrasion resistant insert of the plurality of abrasion resistant inserts has a rectangular shape.

14. The drill bit of claim 1, wherein the one transition section has a curvature in a plane including the respective transition section and a vertical axis that is perpendicular to a profile of the drill bit with a radius ranging from approximately 1 millimeter to 3.5 millimeters.

15. The drill bit of claim 14, wherein the radius ranges between approximately 1 millimeter and 2 millimeters.

16. The drill bit of claim 1, wherein the one transition section of the blade forms a bevel edge with the leading section of the blade and the top section of the blade.

17. The drill bit of claim 1, wherein a spacing between each cutter pocket and an adjacent abrasion resistant insert is up to approximately 2 millimeters.

18. The drill bit of claim 1, wherein the one transition section of the blade forms a chamfered edge with the leading section of the blade and the top section of the blade.

19. A drill bit for drilling a hole in an earth formation, the drill bit comprising:

a bit body;

a blade extending from the bit body, the blade having a leading section, a top section, and a plurality of transition sections extending between the leading section and the top section, wherein the leading section faces a direction of rotation of the drill bit;

a plurality of cutters, each cutter positioned in a respective cutter pocket formed in the blade, wherein each cutter extends beyond the top section of the blade, wherein each transition section of the blade is between adjacent cutter pockets; and an abrasion resistant insert positioned in a respective insert pocket formed in the blade and designed to cut into an earth formation, wherein a top portion of the abrasion resistant insert is disposed at the top section of the blade and extends from one of the transition sections of the blade, wherein the abrasion resistant insert has an hourglass shape, and wherein a transition portion of the abrasion resistant insert is disposed at the one transition section of the blade.

20. The drill bit of claim 19, wherein the top portion of the abrasion resistant insert extends out beyond the top section of the blade by a distance of up to 6 millimeters.

21. The drill bit of claim 19, wherein the abrasion resistant insert is a thermally stabilized polycrystalline (TSP) diamond element.

22. The drill bit of claim 19, wherein a leading portion of the abrasion resistant insert is disposed at the leading section of the blade.

* * * * *